US009288588B2

(12) United States Patent
Mesfin

(10) Patent No.: US 9,288,588 B2
(45) Date of Patent: Mar. 15, 2016

(54) METHOD AND APPARATUS FOR CREATING BINAURAL BEATS USING HEARING AIDS

(71) Applicant: Starkey Laboratories, Inc., Eden Prairie, MN (US)

(72) Inventor: Yezihalem Mesfin, Eden Prairie, MN (US)

(73) Assignee: Starkey Laboratories, Inc, Eden Prairie, MN (US)

( * ) Notice: Subject to any disclaimer, the term of this patent is extended or adjusted under 35 U.S.C. 154(b) by 0 days.

(21) Appl. No.: 14/019,892

(22) Filed: Sep. 6, 2013

(65) Prior Publication Data

US 2015/0071448 A1 Mar. 12, 2015

(51) Int. Cl.
*H04R 25/00* (2006.01)

(52) U.S. Cl.
CPC ..... *H04R 25/552* (2013.01); *H04R 25/606* (2013.01); *H04R 2430/03* (2013.01)

(58) Field of Classification Search
CPC ..... H04R 25/552; H04R 25/606; H04R 2430/03; A61N 1/36032
USPC ..... 381/23.1, 312, 315; 600/26–28
See application file for complete search history.

(56) References Cited

U.S. PATENT DOCUMENTS

| | | | | |
|---|---|---|---|---|
| 7,354,395 | B2 | 4/2008 | Lawlis et al. | |
| 2004/0052391 | A1 * | 3/2004 | Bren et al. | 381/331 |
| 2010/0056854 | A1 | 3/2010 | Chang | |
| 2012/0029379 | A1 * | 2/2012 | Sivadas | 600/545 |
| 2013/0177883 | A1 | 7/2013 | Barnehama et al. | |
| 2013/0202119 | A1 * | 8/2013 | Thiede | A61B 5/0482 381/23.1 |

FOREIGN PATENT DOCUMENTS

WO WO 2012/103940 * 8/2012

* cited by examiner

*Primary Examiner* — Tuan D Nguyen
(74) *Attorney, Agent, or Firm* — Schwegman Lundberg & Woessner, P.A.

(57) ABSTRACT

A hearing assistance system includes a pair of first and second hearing aids to generate a first acoustic signal having a first frequency and a second acoustic signal having a second frequency. When the first and second acoustic signals are each delivered to one of the ears of a listener being a hearing aid wearer, the listener perceives binaural beats at a third frequency being the difference between the first and second frequency. The effects of the binaural beats may include various health or other benefits to the hearing aid wearer.

20 Claims, 5 Drawing Sheets

METHOD AND APPARATUS FOR CREATING BINAURAL BEATS USING HEARING AIDS

TECHNICAL FIELD

This application relates generally to hearing assistance system and, more particularly, to systems, devices and methods for creating binaural beats using a pair of hearing aids.

BACKGROUND

Binaural beats are imaginary tones perceived ("heard") by a person in response to some physical stimuli. When two tones at specific frequencies, one slightly different than the other (by less than 40 Hz) and both below 1,000 Hz, are played to the right and left ears of the person through a stereo headphone, the person's brain may produce a third tone that is perceived at a frequency that is equal to the difference between the frequencies of the two tones. This third tone is an imagined tone which is a three-dimensional audio hallucination heard only within the head of the listener. This phenomenon is known as binaural beats. Binaural Beats are believed to be effective in relieving tension, stress, and anxiety by directly stimulating the listener's brain. A substantial population of people is reportedly using this effect for meditation and relaxation.

People may get the experience with binaural beats by playing pre-recorded audio files through stereo headphones. Because brains are different, different people will not have the same exact experience from the same audio recording. Therefore, each recording for producing binaural beats for a specific purpose is tuned for that specific purpose, such as weight loss, meditation, relaxation, and health. There is a need for providing means for creating binaural beats in people who may potentially benefit from their effects, including hearing impaired individuals.

SUMMARY

A hearing assistance system includes a pair of hearing aids to generate a first acoustic signal having a first frequency and a second acoustic signal having a second frequency. The first and second acoustic signals are each delivered to one of a hearing aid wearer's ears for the hearing aid wearer to perceive binaural beats at a third frequency being the difference between the first and second frequencies. The effects of the binaural beats may include various health or other benefits to the hearing aid wearer.

In one embodiment, a hearing assistance system includes a hearing aid set configured to be worn by a listener (hearing aid wearer). The hearing aid set includes first and second hearing aids. The first hearing aid is configured to generate a first acoustic signal having a first frequency and deliver the first acoustic signal to the listener. The second hearing aid is communicatively coupled to the first hearing aid and configured to generate a second acoustic signal having a second frequency and deliver the second acoustic signal to the listener. The second frequency differs from the first frequency such that binaural beats are created to be perceived by the listener by simultaneously delivering the first acoustic signal and the second acoustic signal to the listener. The binaural beats have a third frequency being a difference between the first frequency and the second frequency.

In one embodiment, a method for operating a hearing assistance system is provided. First and second acoustic signals are generated. The first acoustic signal has a first frequency. The second acoustic signal has a second frequency that differs from the first frequency such that binaural beats are created to be perceived by the listener by simultaneously delivering the first acoustic signal to a first ear of the listener and the second acoustic signal to a second ear of the listener. The binaural beats have a third frequency being a difference between the first frequency and the second frequency. The first acoustic signal is delivered to the first ear of the listener using a first hearing aid of the hearing assistance system. The second acoustic signal is delivered to the second ear of the listener using a second hearing aid of the hearing assistance system.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a hearing assistance system including a pair of left and right hearing aids configured to generate and play tones to create binaural beats in a hearing impaired person. Stereo headphones have been used to play pre-recorded sounds for creating binaural beats, but may not work well for the hearing impaired person when being worn alone or over hearing aids. The present subject matter uses a pair of hearing aids to play tones at different frequencies into the two ears of a hearing aid wearer to create the binaural beats effect, thereby extending the benefit of binaural beats to hearing impaired people who may also need the hearing aids for reasons unrelated to binaural beats. For example, the pair of hearing aids can have a binaural beats mode as one of its operational modes and can be selected by the hearing aid wearer through a memory switch or a remote control. Various pre-recorded tones can be stored in the memory of the pair of hearing aids such that the hearing aid wearer can select preset binaural beats patterns for different needs, such as relaxation, stress relief, treatment of a medical condition, or meditation.

The hearing aid wearer may use the pair of hearing aid to compensate for hearing loss and switch to the binaural mode as needed, such as when he or she needs to relax, sleep, etc., without the need for an external audio recording and a stereo headphone.

In various embodiments, one or more pairs of tones are generated and played from a pair of left and right hearing aids to create binaural beats to be perceived by the hearing aid wearer. In various embodiments, a base frequency and frequency difference as well as levels of the tones can be programmable to fit the needs of individual hearing aid wearers.

Figure 1:
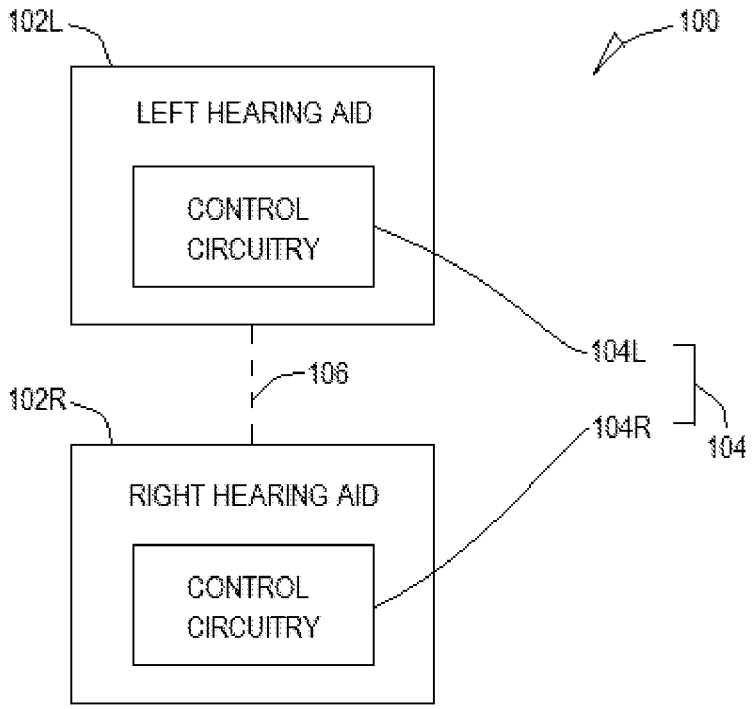
FIG. 1 is a block diagram illustrating an embodiment of a hearing assistance system.

FIG. 1 is a block diagram illustrating an embodiment of a hearing assistance system 100 for delivering sounds to a listener. System 100 includes a hearing aid set configured to be worn by the listener (hearing aid wearer). The hearing aid set includes a left hearing aid 102L and a right hearing aid 102R. Left hearing aid 102L is configured to generate a first acoustic signal and deliver the first acoustic signal to the left ear of the listener. The first acoustic signal has a first frequency. Right hearing aid 102R is configured to generate a second acoustic signal and deliver the second acoustic signal to the right ear of the listener. The second acoustic signal has a second frequency. The second frequency differs from the first frequency such that binaural beats are created to be perceived by the listener by simultaneously delivering the first acoustic signal and the second acoustic signal to the listener using the hearing aid set. The binaural beats have a third frequency that is the difference between the first frequency and the second frequency. In other words, the listener perceives an imaginary tone at the third frequency as the first and second signals are played into his left and right ears, respectively. In various embodiments, the first and second frequencies are each in the range of approximately 100 Hz to 1,000 Hz, and the third frequency is controlled to be in the range of approximately 4 Hz to 40 Hz.

The hearing aid set includes control circuitry 104 configured to control operation of left hearing aid 102L and right hearing aid 102R. Control circuitry 104 includes a first portion 104L in left hearing aid 102L and a second portion 104R in right hearing aid 102R. In various embodiments, control circuitry 104 may be structurally and functionally divided into first portion 104L and second portion 104R in various ways based on design considerations as understood by those skilled in the art. In various embodiments, control circuitry 104 generates the first and second acoustic signals and controls their delivery to the ears of the listener.

A binaural link 106 provides for communication between left hearing aid 102L and right hearing aid 102R to allow the delivery of the first acoustic signal and the delivery of the second acoustic signals to be synchronized to control the third frequency, i.e., the frequency of the binaural beats. In various embodiments, the third frequency is determined based on the specific purpose for which the binaural beats are to be created. In various embodiments, binaural link 106 includes a wired or wireless communication link providing for communications between left hearing aid 102L and right hearing aid 102R. In various embodiments, binaural link 106 may include an electrical, magnetic, electromagnetic, or acoustic (e.g., bone conducted) coupling.

Figure 2:
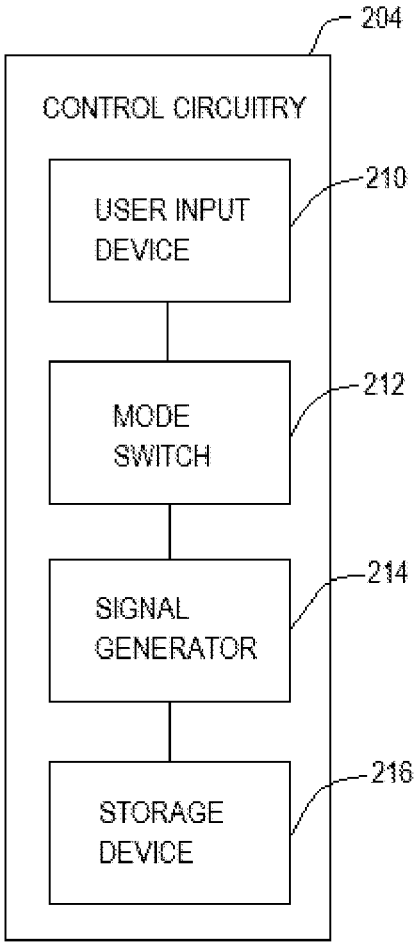
FIG. 2 is a block diagram illustrating an embodiment of control circuitry of the hearing assistance system.

FIG. 2 is a block diagram illustrating an embodiment of control circuitry 204, which represents an example embodiment of control circuitry 104. Control circuitry 204 includes a user input device 210, a mode switch 212, a signal generator 214, and a storage device (memory) 216. In various embodiments, the hearing aid set, which includes left hearing aid 102L and right hearing aid 102R, includes a plurality of operation modes and allows the listener to select a current operation mode from the plurality of operation modes. The plurality of operation modes includes a binaural beats mode. User input device 210 receives a user selection command specifying the current operation mode. Mode switch 212 switches the current operation mode in response to the user selection command. In response to the user selection command specifying the binaural beats mode, mode switch 212 switches the current operation mode to start operation of the hearing aid set in the binaural beats mode. Signal generator 214 generates the first acoustic signal and the second acoustic signal during the binaural beats mode. Storage device 216 stores one or more signal sets for use in the creation of the binaural beats. In one embodiment, generator 214 selects a signal set from the one or more signal sets stored in storage device 216 and generates the first acoustic signal and the second acoustic signal using the selected signal set. In one embodiment, generator 214 selects the signal set according to the user selection command, which specifies the signal set.

In one embodiment, the one or more signal sets stored in storage device 216 are each produced for one or more purposes such as to improve attention of the listener, to improve health of the listener, to treat a medical condition of the listener, to promote mental health of the listener, and to promote relaxation of the listener. In various embodiments, the third frequency (frequency of the binaural beats) is determined based on the specific purpose of the binaural beats, and a signal set is produced for that specific purposes. In various embodiments, the third frequency is also customized for individual listeners. The produced one or more signal sets are then stored in storage device 216 for the listener to choose from as needed. Specific examples of the one or more signal sets include one or more signal sets for increasing attention, attention maintenance, increasing focus, relaxation, calming, mood elevation, stress relief, pain control, weight control, weight control, treating depression, treating anxiety, treating addictions, treating sleep disorders, treating Parkinson's disease, treating Alzheimer's diseases, treating hypertension, treating diabetes, and/or treating sexual dysfunctions. In various embodiments, any purposes for using the binaural beats may be served using a pair of hearing aids without departing from the scope of the present subject matter.

Figure 3:
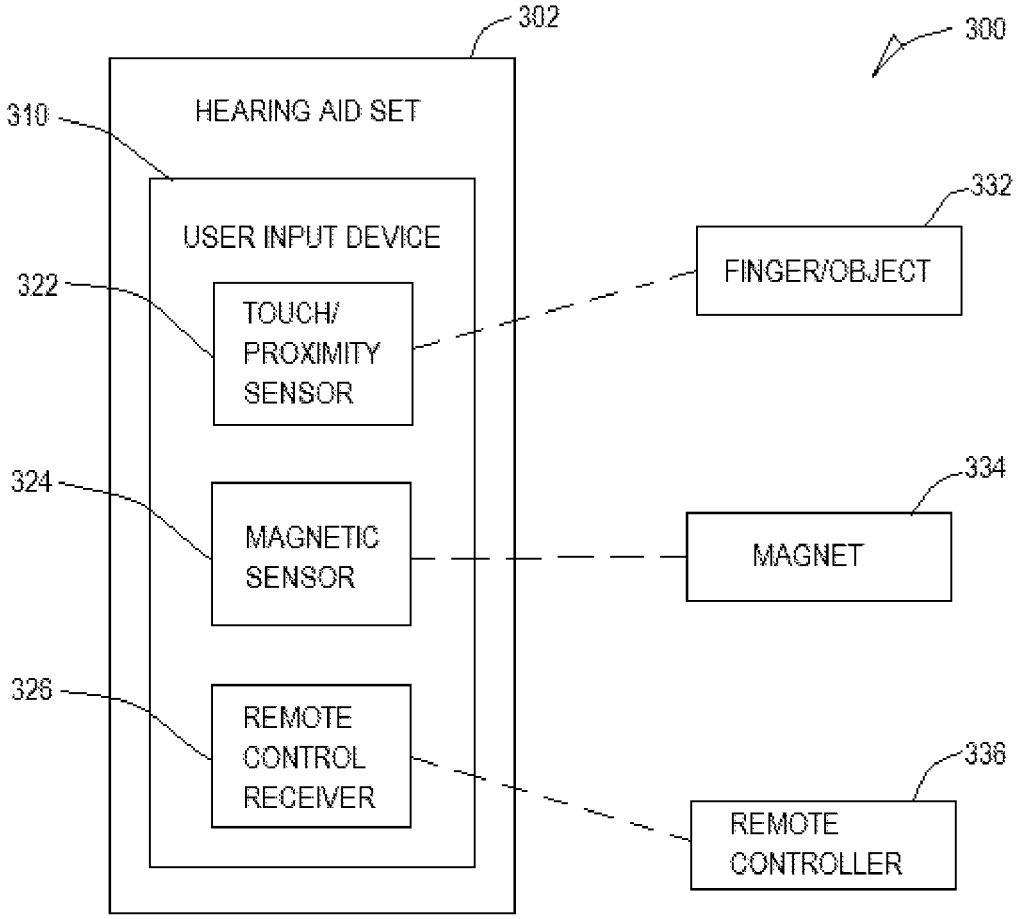
FIG. 3 is a block diagram illustrating a system for selecting an operation mode of the hearing assistance system.

FIG. 3 is a block diagram illustrating a system for selecting an operation mode of a hearing assistance system 300, which represents an example embodiment of system 100. In the illustrated system, hearing aid set 302, which represents an example embodiment of the hearing aid set including left hearing aid 102L and right hearing aid 102R, includes a user input device 310. User input device 310 represents an example embodiment of user input device 210 and may be realized in either one or both of a left hearing aid and a right hearing aid of hearing aid set 302.

In the illustrated embodiment, user input device 310 includes a touch or proximity sensor 322, a magnetic sensor 324, and a remote control receiver 326. In various embodiments, user input device 310 may include any one of touch or proximity sensor 322, magnetic sensor 324, and remote control receiver 326, or any combination of two or three of touch or proximity sensor 322, magnetic sensor 324, and remote control receiver 326. Touch or proximity sensor 322 senses touch or proximity of an object 332 such as a finger as the user selection command. Magnetic sensor 324 senses a magnetic field generated, such as by using a magnet 334 brought to the proximity of the hearing aid set, as the user selection command. Examples of such touch, proximity, and/or magnetic sensors are discussed in U.S. patent application Ser. No. 12/813,202, "METHOD AND APPARATUS FOR A FINGER SENSOR FOR A HEARING ASSISTANCE DEVICE", filed on Jun. 10, 2010, U.S. patent application Ser. No. 13/179,784, "HEARING AID WITH MAGNETOSTRICTIVE ELECTROACTIVE SENSOR", filed on Jul. 11, 2011, published as US 2013/0016862 A1, and U.S. patent application Ser. No. 13/718,858, "HEARING AID WITH INTEGRATED FLEXIBLE DISPLAY AND TOUCH SENSOR", filed on Dec. 12, 2012, published as US 2013/0195298 A1, all assigned to Starkey Laboratories, Inc., which are incorporated herein by reference in their entirety. Remote control receiver 326 receives the user selection command wirelessly transmitted to the hearing aid set, such as from a remote controller 336. Remote controller 336 receives the user selection command from the listener and transmits the user selection command to hearing aid set 302. In various embodiments, any types of user input device may be used in system 300 without departing from the scope of the present subject matter.

Figure 4:
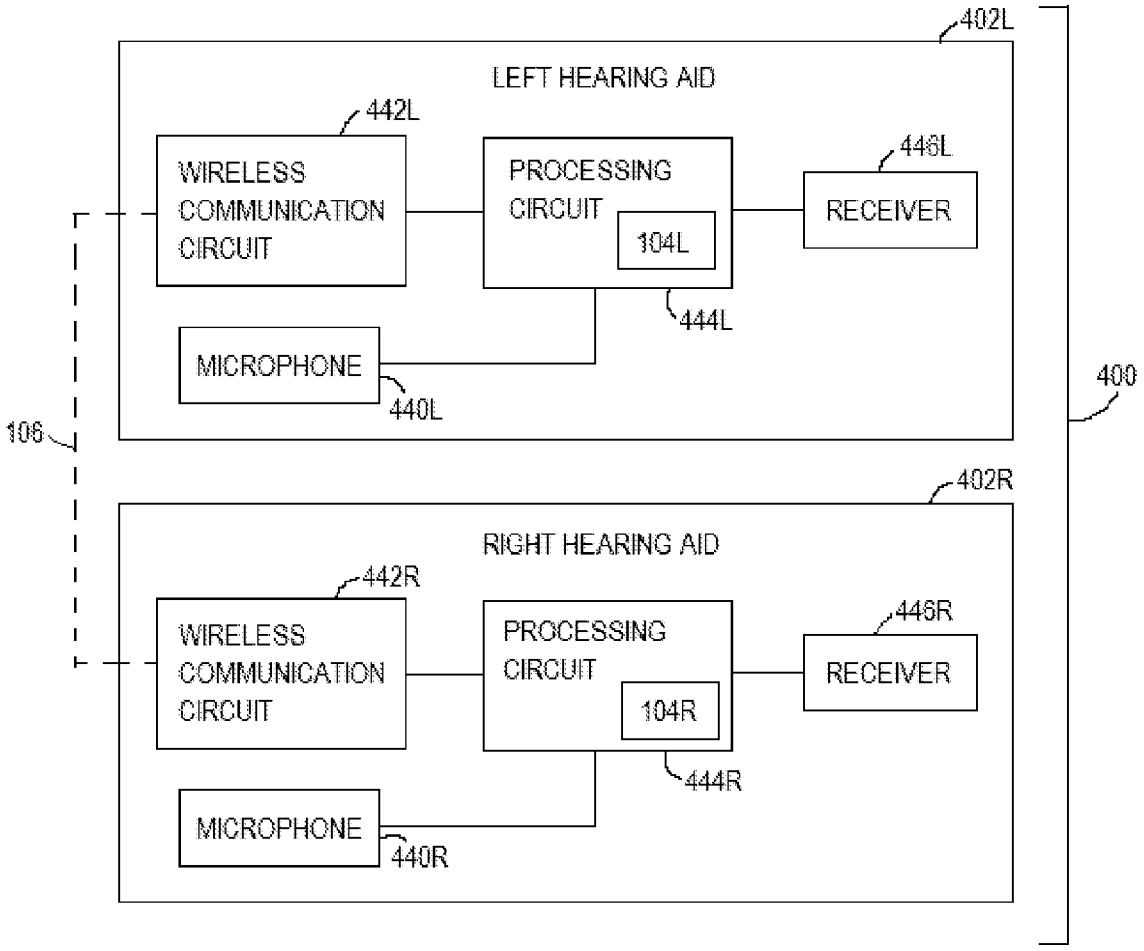
FIG. 4 is a block diagram illustrating another embodiment of the hearing assistance system.

FIG. 4 is a block diagram illustrating an embodiment of a hearing assistance system 400, which represents an example embodiment of system 100 or 300. System 400 includes a hearing aid set including a left hearing aid 402L and a right hearing aid 402R. Left hearing aid 402L includes a microphone 440L, a wireless communication circuit 442L, a processing circuit 444L, and a receiver (also known as a speaker) 446L. Microphone 440L receives sounds from the environment of the listener (hearing aid wearer) and produces a left microphone signal representing the received sounds. Wireless communication circuit 442L wirelessly communicates with right hearing aid 402R via binaural link 106. Processing circuit 444L includes first portions 104L of control circuitry 104 to produce the left acoustic signal during the binaural beats mode, and processes the left microphone signal and/or a signal received by wireless communication circuit 442L to produce the left acoustic signal during another mode of the plurality of operation mode of the hearing aid set. Receiver 446L transmits the left acoustic signal to the left ear of the listener.

Right hearing aid 402R includes a microphone 440R, a wireless communication circuit 442R, a processing circuit 444R, and a receiver (also known as a speaker) 446R. Microphone 440R receives sounds from the environment of the listener (hearing aid wearer) and produces a right microphone signal representing the received sounds. Wireless communication circuit 442R wirelessly communicates with left hearing aid 402L via binaural link 106. Processing circuit 444R includes second portions 104R of control circuitry 104 to produce the right acoustic signal during the binaural beats mode, and processes the right microphone signal and/or a signal received by wireless communication circuit 442R to produce the right acoustic signal during the other mode of the plurality of operation mode of the hearing aid set. Receiver 446R transmits the right acoustic signal to the right ear of the listener. During the binaural beats mode, the left and right acoustic signals are transmitted for the binaural beats to be perceived by the listener.

The hearing aids 402L and 402R and their operation modes are discussed as examples for the purpose of illustration rather than restriction. It is understood that binary link 106 may include any type of wired or wireless link capable of providing the required communication in the present subject matter. In various embodiments, hearing aids 402L and 402R may communicate with each other via any wired and/or wireless couple.

In various embodiments, at least one of processing circuits 444L and 444R includes signal generator 214 and storage device 216. In one embodiment, processing circuit 444L includes signal generator 214 configured to produce the left acoustic signal and the right acoustic signal, and the right acoustic signal is transmitted to processing circuit 444R through binaural link 106 using communication circuits 442L and 442R. In another embodiment, processing circuit 444R includes signal generator 214 configured to produce the right acoustic signal and the left acoustic signal, and the left acoustic signal is transmitted to processing circuit 444L through binaural link 106 using communication circuits 442R and 442L. In another embodiment, processing circuit 444L including a first portion of signal generator 214 configured to produce the left acoustic signal, and processing circuit 444R includes a second portion of signal generator 214 configured to produce the right acoustic signal.

Figure 5:
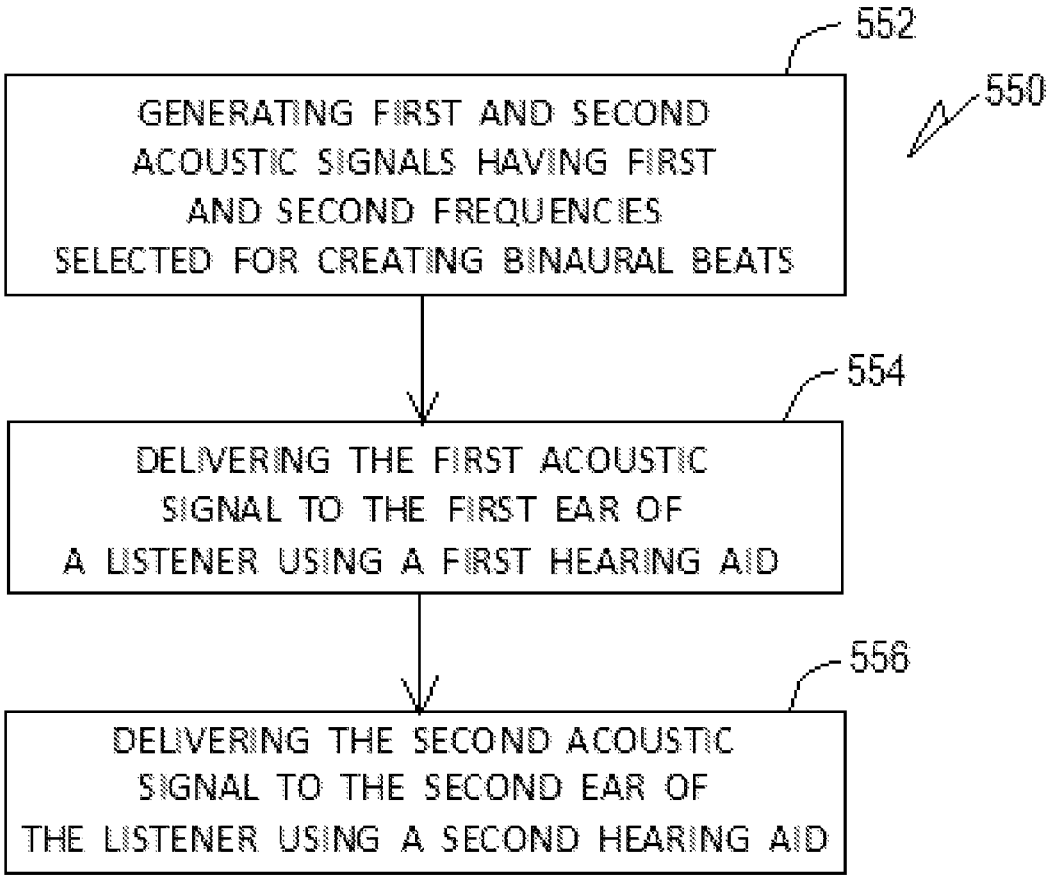
FIG. 5 is a flow chart illustrating an embodiment of a method for creating binaural beats using the hearing assistance system.

FIG. 5 is a flow chart illustrating an embodiment of a method 550 for creating binaural beats using a hearing assistance system including a pair of hearing aids, such as hearing assistance system 100 including hearing aids 102L and 102R, including the various example embodiments of system 100 and hearing aids 102L and 102R as discussed in this document. For the purpose of discussing method 550, the hearing aids are referred to as a first hearing aid and a second hearing aid. In various embodiments, either one of the first and second hearing aids may be configured as left hearing aid 102L, and the other configured as right hearing aid 102R. In one embodiment, control circuitry 104 is configured to perform method 550.

At 552, a first acoustic signal and a second acoustic signal are generated. The first acoustic signal has a first frequency. The second acoustic signal has a second frequency. The second frequency differs from the first frequency such that binaural beats are created to be perceived by a listener by simultaneously delivering the first acoustic signal to the first ear of the listener using the first hearing aid and the second acoustic signal to the second ear of the listener using the second hearing aid. The binaural beats have a third frequency being a difference between the first frequency and the second frequency. In various embodiments, the first and second acoustic signals are generated in the first and second hearing aids.

At 554, the first acoustic signal is delivered to the first ear of the listener using the first hearing aid. At 556, the second acoustic signal is delivered to the second ear of the listener using the second hearing aid. In various embodiments, method 550 is performed in response to a user selection command selecting a binaural beats mode from a plurality of operation modes of the hearing assistance system. Thus, the first and second acoustic signals can be generated and delivered to the listener in response to the listener entering the user selection command, when the listener wants to benefit from effects of the binaural beats.

In various embodiments, the first and second acoustic signals are generated at 552 using a stored signal set selected by the listener. One or more signal sets are stored in the hearing assistance system to be available for the listener to select based on his or her purpose for the binaural beats. In such embodiments, the user selection command may specify the signal set in addition to the binaural beats mode. The signal set is selected from the stored one or more signal sets according to the user selection command specifying the signal set. In various embodiments, the listener may select the signal set for improving attention, improving health, treating a medical condition, promoting mental health, and/or promoting relaxation.

It is understood that the hearing aids referenced in this patent application include a processor (such as processing circuits 444L and 444R). The processor may be a digital signal processor (DSP), microprocessor, microcontroller, or other digital logic. The processing of signals referenced in this application can be performed using the processor. Processing may be done in the digital domain, the analog domain, or combinations thereof. Processing may be done using sub-band processing techniques. Processing may be done with frequency domain or time domain approaches. For simplicity, in some examples blocks used to perform frequency synthesis, frequency analysis, analog-to-digital conversion, amplification, and certain types of filtering and processing may be omitted for brevity. In various embodiments the processor is adapted to perform instructions stored in memory which may or may not be explicitly shown. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices. It is understood that other hearing assistance devices not expressly stated herein may be used in conjunction with the present subject matter.

The above detailed description is intended to be illustrative, and not restrictive. Other embodiments will be apparent to those of skill in the art upon reading and understanding the above description. The scope of the invention should, therefore, be determined with reference to the appended claims, along with the full scope of equivalents to which such claims are entitled.

What is claimed is:

1. A hearing assistance system for delivering sounds to a listener, comprising:

a hearing aid set configured to be worn by the listener, the hearing aid set including:

a first hearing aid configured to generate a first acoustic signal having a first frequency and deliver the first acoustic signal to the listener;

a second hearing aid communicatively coupled to the first hearing aid and configured to generate a second acoustic signal having a second frequency and deliver the second acoustic signal to the listener, the second frequency differing from the first frequency such that binaural beats are created to be perceived by the listener by simultaneously delivering the first acoustic signal and the second acoustic signal to the listener, the binaural beats having a third frequency being a difference between the first frequency and the second frequency; and control circuitry including a first portion in the first hearing aid and a second portion in the second hearing aid, the control circuitry including:

a user input device configured to receive a user selection command;

a storage device;

signal sets stored in the storage device, the signal sets each produced for a specific purpose of creating the binaural beats; and a signal generator configured to select a signal set from the signal sets stored in the storage device according to the user selection command and generate the first acoustic signal and the second acoustic signal using the selected signal set.

2. The system of claim 1, wherein the hearing aid set is configured to operate in a selected mode of a plurality of operation modes including a binaural beats mode.

3. The system of claim 2, wherein the user selection command comprises a command selecting the binaural beats mode, and the control circuitry comprises a mode switch configured to start operation of the hearing aid set in the binaural beats mode in response to the user selection command, and wherein the signal generator is configured to generate the first acoustic signal and the second acoustic signal during the binaural beats mode.

4. The system of claim 3, wherein the signal sets stored in the storage device comprise one or more signal sets produced for creating the binaural beats with the third frequency customized for the listener.

5. The system of claim 3, wherein the user selection command further comprises a command selecting the signal set, and the signal generator is configured to select the signal set from the signal sets according to the user selection command.

6. The system of claim 3, wherein the user input device comprises a touch or proximity sensor configured to sense touch or proximity of an object as the user selection command.

7. The system of claim 3, wherein the user input device comprises a magnetic sensor configured to sense a magnetic field generated as the user selection command.

8. The system of claim 3, wherein the user input device comprises a remote control receiver configured to receive the user selection command wirelessly transmitted to the hearing aid set.

9. The system of claim 3, comprising a communication link configured to provide wireless communication between the first and second portions of the control circuitry, and wherein the first portion of the control circuitry is configured to generate the first acoustic signal and the second acoustic signal, and the second portion of the control circuitry is configured to receive the second acoustic signal transmitted from the first portion of the control circuitry.

10. The system of claim 3, comprising a communication link configured to provide wireless communication between the first and second portions of the control circuitry, and wherein the first portion of the control circuitry is configured to generate the first acoustic signal, and the second portion of the control circuitry is configured to generate the second acoustic signal.

11. A method for operating a hearing assistance system for delivering sounds to a listener having first and second ears, comprising:

storing signal sets each produced for a specific purpose of creating binaural beats;

receiving from the listener a selection of a signal set from the stored signal sets;

generating a first acoustic signal and a second acoustic signal using the selected signal set, the first acoustic signal having a first frequency,. the second acoustic signal having a second frequency, the second frequency differing from the first frequency such that binaural beats are created to be perceived by the listener by simultaneously delivering the first acoustic signal to the first ear of the listener and the second acoustic signal to the second ear of the listener, the binaural beats having a third frequency being a difference between the first frequency and the second frequency;

delivering the first acoustic signal to the first ear of the listener using a first hearing aid of the hearing assistance system; and delivering the second acoustic signal to the second ear of the listener using a second hearing aid of the hearing assistance system.

12. The method of claim 11, comprising generating the first and second acoustic signals using the first and second hearing aids.

13. The method of claim 12, comprising generating and delivering the first and second acoustic signals in response to a user selection command selecting a binaural beats mode from a plurality of operation modes of the hearing assistance system.

14. The method of claim 13, wherein selecting the signal set from the stored signal sets comprises selecting the signal set from the stored signal sets according to the user selection command wherein the user selection command specifies the signal set.

15. The method of claim 13, wherein storing signal sets comprises storing a signal set produced to provide the third frequency selected to improve attention of the listener.

16. The method of claim 13, wherein storing signal sets comprises storing a signal set produced to provide the third frequency selected to improve health of the listener.

17. The method of claim 13, wherein storing signal sets comprises storing a signal set produced to provide the third frequency selected to treat a medical condition of the listener.

18. The method of claim 13, wherein storing signal sets comprises storing a signal set produced to provide the third frequency selected to promote mental health of the listener.

19. The method of claim 13, wherein storing signal sets comprises storing a signal set produced to provide the third frequency selected to promote relaxation of the listener.

20. The method of claim 11, wherein generating the first acoustic signal and the second acoustic signal comprises generating the first acoustic signal and the second acoustic signal to result in the third frequency being in a range of approximately 4 Hz to 40 Hz.

* * * * *